US006864449B2

(12) United States Patent
Ito

(10) Patent No.: US 6,864,449 B2
(45) Date of Patent: Mar. 8, 2005

(54) KEYSWITCH HAVING BENDING LINKS

(75) Inventor: Hideki Ito, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 38 days.

(21) Appl. No.: 10/627,291

(22) Filed: Jul. 25, 2003

(65) Prior Publication Data

US 2004/0238336 A1 Dec. 2, 2004

(30) Foreign Application Priority Data

Aug. 7, 2002 (JP) ..... 2002-230440

(51) Int. Cl.[7] ..... H01H 13/70
(52) U.S. Cl. ..... 200/344
(58) Field of Search ..... 200/5 A, 517, 200/344, 345; 400/490–496

(56) References Cited

U.S. PATENT DOCUMENTS 5,329,084 A * 7/1994 Watanabe et al. ..... 200/344
5,823,325 A * 10/1998 Lin ..... 200/344
6,100,482 A * 8/2000 Koma et al. ..... 200/344
6,509,536 B2 * 1/2003 Sasaki ..... 200/344
6,713,699 B2 * 3/2004 Yoneyama ..... 200/344
6,723,935 B1 * 4/2004 Watanabe ..... 200/344
6,730,868 B1 * 5/2004 Watanabe ..... 200/344

FOREIGN PATENT DOCUMENTS

JP 11-39986 12/1999

* cited by examiner

*Primary Examiner*—Michael A. Friedhofer
(74) *Attorney, Agent, or Firm*—Brinks Hofer Gilson & Lione

(57) ABSTRACT

A keyswitch includes an elastic member for elastically biasing a keytop upward, a base for supporting the elastic member, and a switch circuit which includes stationary contacts and a movable contact for switching states of the switch circuit by vertically operating the keytop. A first link and a second link each include two plates that are hinged so as to be foldable at an intersection as fulcra, and are disposed adjacent each other with a predetermined angle therebetween. In response to the stretching and compression of the elastic member by vertically operating the keytop, the folding angles between the two plates of the first link and the two plates of the second link are variable.

7 Claims, 4 Drawing Sheets

KEYSWITCH HAVING BENDING LINKS

BACKGROUND OF THE INVENTION

1. Field of the Invention

The present invention relates to a keyswitch, and, more particularly, to a keyswitch that is suitable for use in an input device of, for example, a personal computer.

2. Description of the Related Art

As shown in FIGS. 9 and 10, a related keyswitch 21 used in an input device of, for example, a personal computer has a base 22 and first engagers 22*a*. The base 22 is disposed at the bottommost portion of the keyswitch 21 and is formed of a metallic plate, such as an aluminum plate. The first engagers 22*a* protrude from the illustrated right side of the base 22.

Each first engager 22*a* comprises two opposing engaging walls 22*b* and 22*b*, which are disposed on both sides of an engaging groove 22*c*. Second engagers 22*d*, which are disposed on the illustrated left side of the respective first engagers 22*a*, each have a slide groove 22*e* and have a substantially L shape. One side of each slide groove 22*e* is open.

As shown in FIG. 10, the first engagers 22*a* and the second engagers 22*d* vertically oppose the base 22.

A membrane switch 23, disposed on the base 22, comprises an upper sheet 23*a*, a lower sheet 23*b*, and a spacer 23*c*. A movable contact (not shown) on the lower surface of the upper sheet 23*a* opposes a stationary contact (not shown) on the upper surface of the lower sheet 23*b*. The spacer 23*c* is disposed between the sheets 23*a* and 23*b*.

The membrane switch 23 has holes (not shown) for receiving the first engagers 22*a* and the second engagers 22*d*. The first engagers 22*a* and the second engagers 22*d* are inserted in the holes, and the membrane switch 23 is disposed on the base 22.

A first lever 24 and a second lever 25, which are combined in the form of a pantograph, are disposed on the membrane switch 23. As shown in FIG. 10, the first lever 24 has a U shape in plan view, and has a pair of opposing arms 24*b*, each having a first engaging protrusion 24*a*.

As shown in FIG. 9, each arm 24*b* is disposed tilted leftward and upward, and has a second engaging protrusion 24*c* at the illustrated upper side thereof.

The arms 24*b* have respective bearings 24*d* that are disposed toward the respective first engaging protrusions 24*a*.

As shown in FIG. 10, the second lever 25 has a substantially rectangular shape in plan view. It has first vertically protruding first bar-shaped engaging protrusions 25*a* and 25*a* on the illustrated right side thereof and second vertically protruding second bar-shaped engaging protrusions 25*b* and 25*b* on the illustrated left side thereof.

The second lever 25 has a circular hole 25*c*, disposed leftward in FIG. 10, for receiving a rubber spring 27 (described later). The rubber spring 27 is positioned at the circular hole 25*c*.

Cylindrical bearings 25*d* and 25*d*, which can be fitted to the respective bearings 24*d* of the first lever 24, protrude from the upper and lower side surfaces of the second lever 25.

By fitting the bearings 25*d* of the second lever 25 to the bearings 24*d* of the first lever 24, as shown in FIG. 9, the first lever 24 and the second lever 25 are combined in the form of a pantograph.

The first engaging protrusions 24*a* of the first lever 24 are rotatably engagingly supported by the respective first engagers 22*a* of the base 22, and the second engaging protrusions 25*b* of the second lever 25 are slidably engagingly supported by the respective second engagers 22*d* of the base 22, so that the first lever 24 and the second lever 25 can move vertically.

A keytop 26 is supported at the top portions of the first lever 24 and the second lever 25. The keytop 26 has first engagers 26*b* on the illustrated right side of a back surface 26*a*. The first engaging protrusions 25*a* of the second lever 25 rotatably engage two engaging walls 26*c* and 26*c* of their respective first engagers 26*b*.

In FIG. 9, second engagers 26*d* are disposed to the left of the first engagers 26*b*. The second engagers 26*d* each have a slide groove 26*e*, which is open on one side. The second engaging protrusions 24*c* of the first lever 54 slidably engage the slide grooves 26*e*.

The rubber spring 27 for resiliently biasing the keytop 26 upward is disposed on substantially the central portion of the back surface 26*a* of the keytop 26. The rubber spring 27 is placed on the membrane switch 23 on the base 22 by being mounted thereto with an adhesive or the like.

The rubber spring 27 has a dome-shaped hollow 27*a* in the inner portion, and a protrusion 27*b* that protrudes downward from the ceiling defining the inner portion of the hollow 27*a*.

A top end 27*c* of the rubber spring 27 is positioned on the back surface 26*a* of the keytop 26.

When the keytop 26 of the above-described related keyswitch 21 is pressed downward, the first lever 24 and the second lever 25, which are in the form of a pantograph, rotate, causing the keytop 26 in a horizontal state to move downward.

At the same time, the keytop 26 that has moved downward elastically deforms the rubber spring 27, so that the protrusion 27*b* in the hollow 27*a* moves downward. The protrusion 27*b* pushes the upper sheet 23*a*, so that the movable contact (not shown) comes into contact with the stationary contact (not shown) on the lower sheet 23*b*, as a result of which the membrane switch 23 is turned on.

Thereafter, when the keytop 26 is released, the keytop 26 returns to its initial upper position by the elastic force of the rubber spring 27, and the first lever 24 and the second lever 25 move upward. The upper sheet 23*a* of the membrane switch 23 returns to its initial state by its own restoring force, and moves out of contact with the lower sheet 23*b*, as a result of which the membrane switch 23 is turned off.

In such a related keyswitch 21, the keytop 26, which is supported by the pair of levers 24 and 25 that are combined in the form of a pantograph, moves vertically in a substantially horizontal state parallel to the base 22 regardless of what part of the keytop 26 is pressed.

Japanese Unexamined Patent Application Publication No. 12-148356 is a document for reference.

However, such a related keyswitch 21 has the problem of reduced assembly efficiency because the structure for supporting the first lever 24 and the second lever 25 in the form of a pantograph is complicated.

In addition, since the first lever 24 and the second lever 25 are combined in the form of a pantograph, the height of the related keyswitch 21 is increased, so that it is difficult to make it thin.

SUMMARY OF THE INVENTION

Accordingly, it is an object of the present invention to provide a keyswitch which makes it possible for a keytop to move vertically in a horizontal state without using two levers that are combined in the form of a pantograph.

To this end, according to a basic form of the present invention, there is provided a keyswitch comprising a keytop, a first link and a second link for vertically movably supporting the keytop, an elastic member for elastically biasing the keytop upward, a base for supporting the elastic member, and a movable contact and a stationary contact for switching states of a switch circuit by vertically operating the keytop. In the keyswitch, the first and second links each have two plates that are hinged so as to be foldable at an intersection, and are disposed adjacent each other with a predetermined angle therebetween. In response to stretching and compression of the elastic member resulting from vertically operating the keytop, folding angles between the two plates of the first link and between the two plates of the second link are variable.

In a first form, the first and second links are disposed orthogonally adjacent each other, with the elastic member being disposed therebetween.

In a second form, the top ends of the first and second links are rotatably supported by the keytop, and the bottom ends of the first and second links are rotatably supported by the base.

In a third form, the first and second links are provided with an upper engaging supporter that rotatably engagingly supports the top ends and are supported by the back surface of the keytop through the upper engaging supporter; or the first and second links are provided with a lower engaging supporter that rotatably engagingly supports the bottom ends, and are supported by the upper surface of the base through the lower engaging supporter; or the first and second links are provided with the upper engaging supporter and the lower engaging supporter that, respectively, rotatably engagingly support the top ends and the bottom ends, and are supported by the back surface of the keytop and the upper surface of the base through the upper engaging supporter and the lower engaging supporter, respectively.

In a fourth form, the keyswitch further comprises a height restricting member for restricting movement of the first and second links to a raised position at a predetermined height.

In a fifth form, when the structure of the fourth form is used, as the height of the top ends of the first and second links increases in response to the stretching and compression of the elastic member, the distance between adjacent side surfaces of the first and second links increases, and the height restricting member restricts the movement of the top ends of the first and second links to the raised position at the predetermined height by restricting the distance between the adjacent side surfaces so that the distance does not become equal to or greater than a predetermined value.

In a sixth form, when the structure of the fifth form is used, the height restricting member bridges portions near the intersections of the adjacent side surfaces.

DESCRIPTION OF THE PREFERRED EMBODIMENTS

Figure 1:
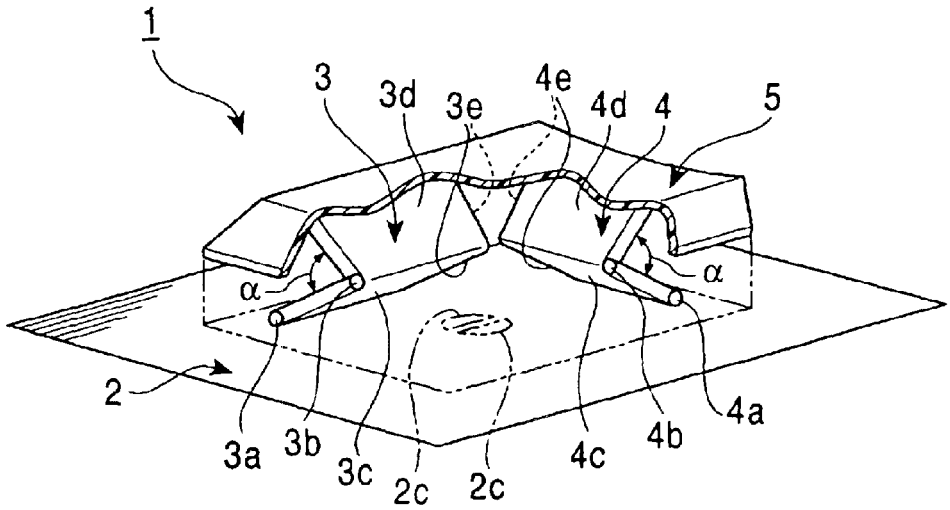
FIG. 1 is a schematic perspective view of a keyswitch of the present invention.
Figure 2:
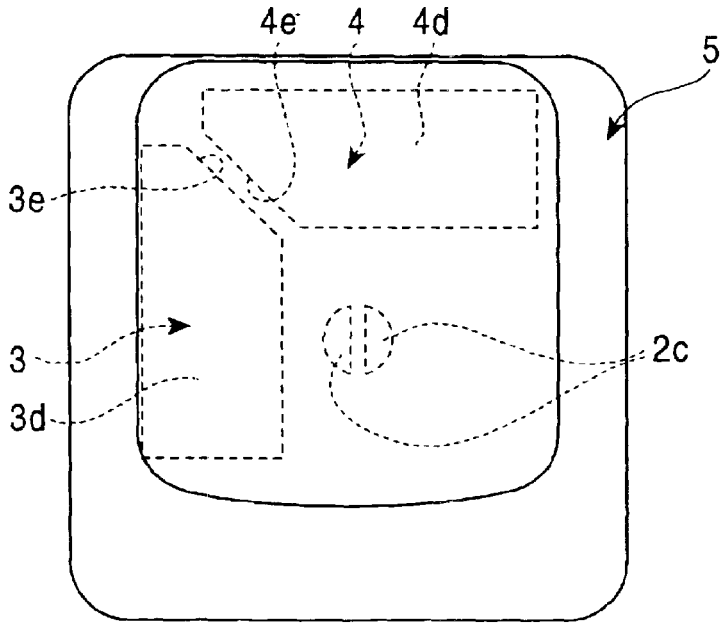
FIG. 2 is a schematic plan view of the keyswitch of the present invention.
Figure 3:
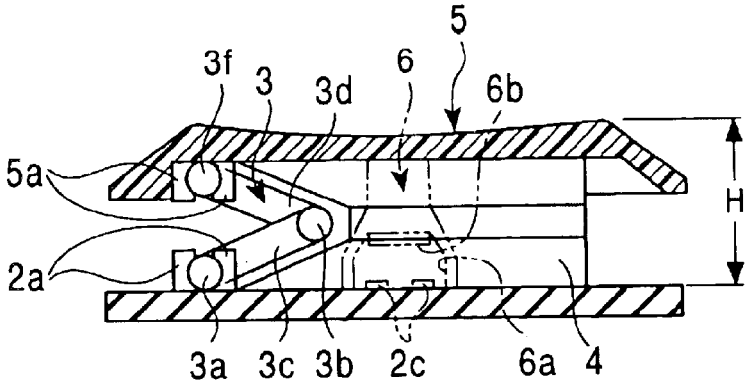
FIG. 3 is a sectional view of the main portion of FIG. 2.
Figure 4:
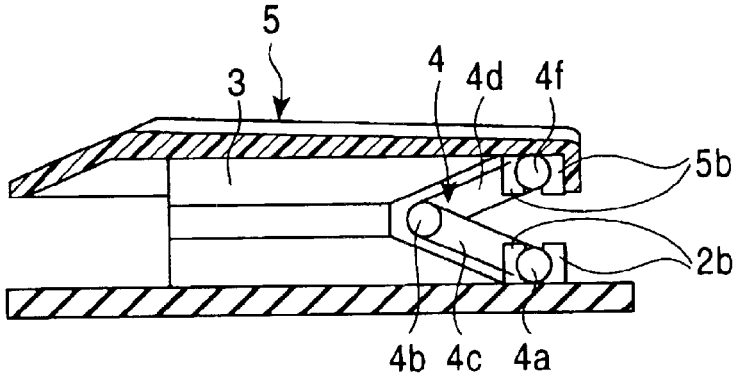
FIG. 4 is a sectional view of the main portion of FIG. 2.
Figure 5:
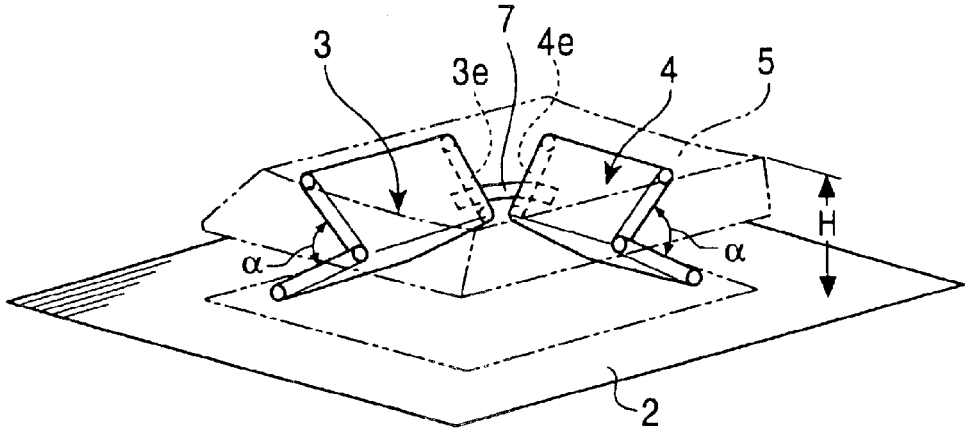
FIG. 5 is a schematic view of a height restricting member used in the present invention.
Figure 6:
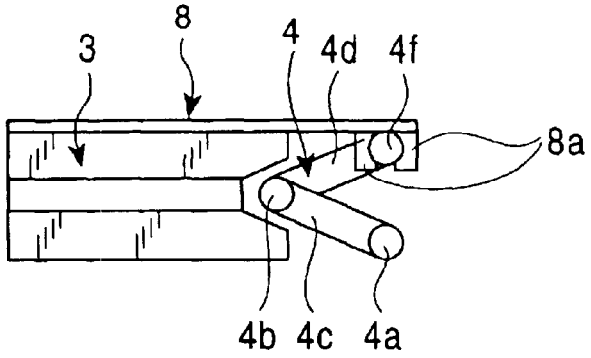
FIG. 6 is a schematic view of another embodiment of the present invention.
Figure 7:
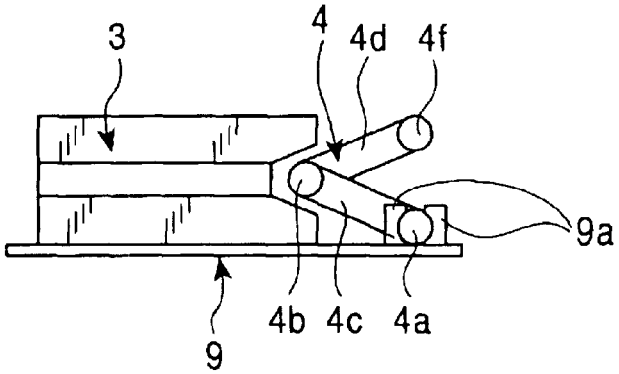
FIG. 7 is a schematic view of still another embodiment of the present invention.
Figure 8:
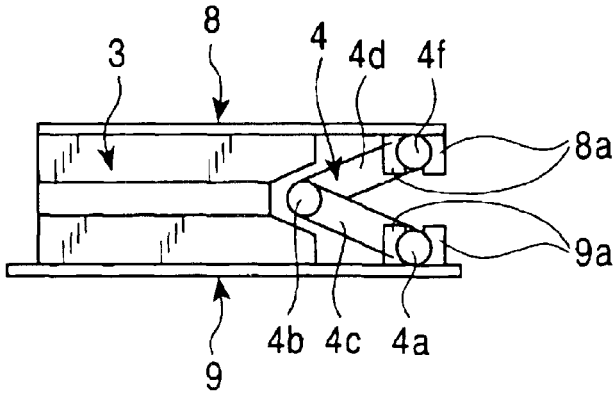
FIG. 8 is a schematic view of still another embodiment of the present invention.
Figure 9:
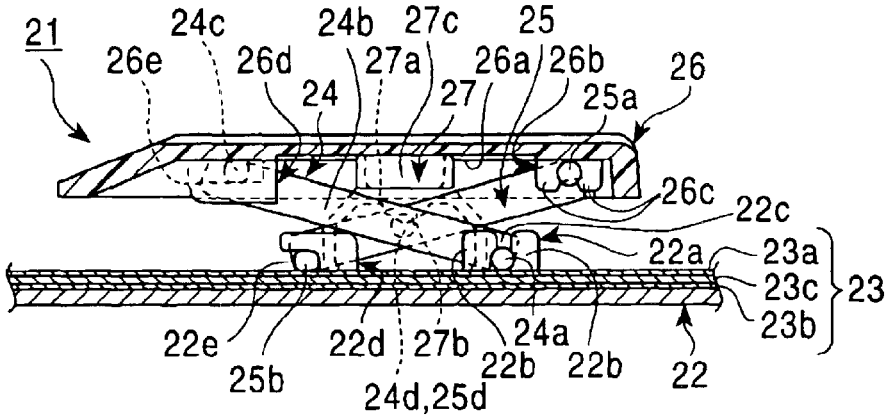
FIG. 9 PRIOR ART
FIG. 9 is a side view of a related keyswitch.
Figure 10:
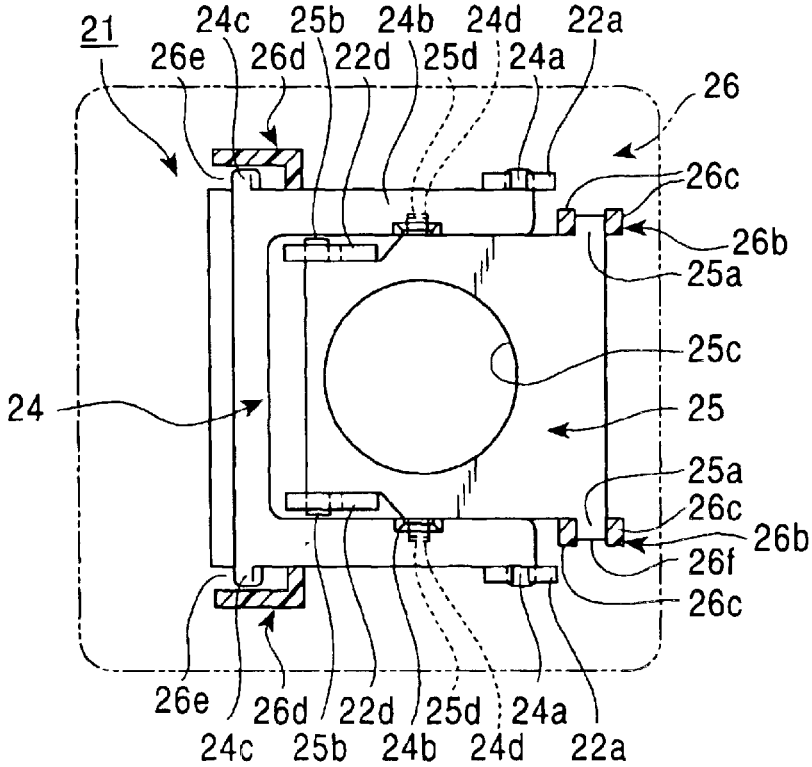
FIG. 10 PRIOR ART
FIG. 10 is a plan view of the related keyswitch.

Hereunder, a description of a keyswitch of a first embodiment of the present invention will be given with reference to the relevant drawings. FIG. 1 is a schematic perspective view of the keyswitch of the first embodiment of the present invention. FIG. 2 is a plan view of the keyswitch of the present invention. FIG. 3 is a sectional view of the main portion of FIG. 2. FIG. 4 is a sectional view of the main portion of FIG. 2. FIG. 5 is a schematic view of a height restricting member used in the present invention. FIGS. 6 to 8 are schematic views of other embodiments of the present invention.

In a keyswitch 1 of the first embodiment of the present invention, as shown in FIG. 1, a base 2 is disposed at the bottommost portion, and, as shown in FIG. 3, a pair of opposing first lower supporting walls 2*a* and 2*a* are disposed apart from each other on the upper surface of the base 2. The base 2 is formed of an insulating plate with a predetermined thickness.

A bottom end 3*a* of a first link 3, which has a substantially V shape in side view, can be supported in the gap between the first lower supporting walls 2*a* and 2*a*.

The first link 3 is foldable by a hinge at two plates 3*c* and 3*d* with an intersection 3*b* as a fulcrum.

As shown by broken lines in FIG. 2, the plates 3*c* and 3*d* have a substantially trapezoidal shape due to respective side surfaces 3*e* being inclined. A top end 3*f* of the plate 3*d* can be supported by a pair of upper supporting walls 5*a* and 5*a* that are formed on a keytop 5 (described later).

As shown in FIG. 2, a second link 4, which is perpendicular to the first link 3, is disposed next to and on the right side of the first link 3. In other words, the first link 3 and the second link 4 are disposed adjacent each other with a predetermined angle therebetween.

As shown in FIGS. 1, 2, and 4, a bottom end 4*a* of the second link 4 can be engagingly supported between a pair of second lower supporting walls 2*b* and 2*b* formed on the base 2.

Plates 4*c* and 4*d* of the second link 4 are formed substantially symmetrical to the plates 3*c* and 3*d* of the first link 3.

The plates 4*c* and 4*d* have respective side surfaces 4*e* that face the corresponding side surfaces 3*e* of the first link 3 and that are inclined. A top end 4*f* of the plate 4*d* can be supported by a pair of second upper supporting walls 5*b* and 5*b* formed on the keytop 5 (described later).

The keytop 5, which has a substantially rectangular shape and which is formed of a resinous material or the like, is disposed on the first link 3 and the second link 4. The pair of first upper supporting walls 5*a* and 5*a* (shown in FIG. 3), which can engagingly support the top end 3*f* of the first link 3, and the pair of second upper supporting walls 5*b* and 5*b* (shown in FIG. 4), which can engagingly support the top end 4*f* of the second link 4, protrude from the back surface of the keytop 5.

An elastic member 6 (shown by alternate long and two short dash lines in FIG. 3), formed of rubber spring, is disposed in an area opposing the keytop 5 on the base 2 shown in FIG. 1 (an area shown by alternate long and two short dash lines).

In the initial state, the elastic member 6 has a dome-shaped hollow 6*a* in the inner portion. An electrically conductive circular movable contact 6*b* is, for example, printed on or adhered to the ceiling defining the hollow 6*a*.

The top end of the elastic member 6 is mounted to the back surface of the keytop 5 with, for example, an adhesive. The bottom end of the elastic member 6 is mounted to the upper surface of the base 2 with, for example, an adhesive.

A pair of semicircular stationary contacts 2*c* and 2*c* (shown in FIG. 2), which are spaced apart from each other, are, for example, printed in an insulated state on a portion of the base 2 opposing the movable contact 6*b*. The movable contact 6*b* and the stationary contacts 2*c* and 2*c* constitute a switch circuit.

When the elastic member 6 in the initial state is elastically deformed and the movable contact 6*b* moves downward and comes into contact with the pair of stationary contacts 2*c* and 2*c*, the pair of stationary contacts 2*c* and 2*c* come into electrical conduction with each other through the movable contact 6*b*, so that the switch circuit is switched on.

In the keyswitch 1 of the present invention, folding angles α between the plates 3*c* and 3*d* of the first link 3 and between the plates 4*c* and 4*d* of the second link 4 are variable in response to the stretching and compression of the elastic member 6 caused by vertically operating the keytop 5.

In response to the restoring of the elastic member 6 that has been elastically deformed by pressing the keytop 5 to its initial state, the first link 3 and the second link 4 move upward, so that heights H of the top ends 3*f* and 4*f* increase. As the heights H of the top ends 3*f* and 4*f* increase, the distance between portions of adjacent side surfaces 3*e* and 4*e* that are disposed near the intersection 3*b* and an intersection 4*b*, respectively, increases.

As shown in FIG. 5, the keyswitch 1 has a height restricting member 7 which can restrict the heights of the top ends 3*f* and 4*f* of the respective first and second links 3 and 4 by restricting the distance between the portions of the adjacent side surfaces 3*e* and 4*e* near the respective intersections 3*b* and 4*b* so that it does not increase further when it becomes a predetermined value.

The height restricting member 7 is formed of a flexible film or tape, and bridges portions of the adjacent side surfaces 3*e* and 4*e* that are disposed near the respective intersections 3*b* and 4*b*. Both ends of the height restricting member 7 are adhered and mounted to the respective plates 3*d* and 4*d* with, for example, an adhesive (not shown).

In the keyswitch 1 of the present invention, since the keytop 5 is supported by adjacent first link 3 and the second link 4 that are orthogonal to each other with the elastic member 6 being disposed therebetween, even if the keytop 5 is not pressed at the same location, the keytop 5 moves vertically in a substantially horizontal state parallel to the base 2.

The operation of the keyswitch 1 of the present invention will be described. First, when the switch circuit is in its initial off state, the keytop 5 is at its raised position and is in a substantially horizontal state parallel to the base 2. The height of the keytop 5 from the base 2 is H.

When the keytop 5 in the initial state is pressed, the keytop 5 moves downward in the horizontal state by the action of the first link 3 and the second link 4. When the keytop 5 is pressed further, the hollow 6*a* of the elastic member 6 is elastically deformed and inverted in shape and generates a tactile feel, and the movable contact 6*b* comes into contact with the pair of stationary contacts 2*c* and 2*c*, so that they are brought into electrical conduction with each other. As a result, the switch circuit is turned on, and the keytop 5 stops moving downward.

At this time, the folded plates 3*c* and 3*d* and 4*c* and 4*d* are-superimposed upon each other. As a result, the distance between the portions of the adjacent side surfaces 3*e* and 4*e* near the respective intersections 3*b* and 4*b* is small, so that the height restricting member 7 is not in a taut state.

When the pressed keytop 5 is released, the keytop 5 automatically returns to its initial raised position by the elastic force of the elastic member 6, and the movable contact 6*b* moves out of contact with the stationary contacts 2*c* and 2*c*, so that the switch circuit is turned off.

In addition, the first link 3 and the second link 4 automatically return to their initial states as a result of an increase in the folding angles α. When the folding angles α return to their initial state values, the distance between the portions of the side surfaces 3*e* and 4*e* near the respective intersections 3*b* and 4*b* is increased, so that the height restricting member 7 no longer has any tautness, thereby making it impossible to increase the distance between the portions of the side surfaces 3*e* and 4*e* near the respective intersections 3*b* and 4*b* to a value equal to or greater than the predetermined value. Therefore, the first link 3 and the second link 4 stop moving upward, so that the keytop 5 stops at its initial raised position.

Since the keytop 5 can be operated vertically in a horizontal state by the first link 3 and the second link 4 that are hinged using a simple structure, the keyswitch 1 of the present invention uses fewer parts, is easily assembled, and has excellent operability.

Although, in the first embodiment of the present invention, the first link 3 and the second link 4 are directly supported by the keytop 5 and the base 2, the present invention is not limited thereto. In other embodiments, as shown in FIGS. 6 to 8, a first link 3 and a second link 4 are supported by a keytop 5 and/or a base 2 through an upper plate-shaped engaging supporter 8 and/or a lower engaging supporter 9. In the embodiment shown in FIG. 6, referring to the second link 4, a top end 4*f* is rotatably engagingly supported by the top plate-shaped engaging supporter 8.

As shown in FIG. 6, when the top end 4*f* is engagingly supported between a pair of protruding supporting walls 8*a* and 8*a* of the upper supporter 8 that can engagingly support the top end 4*f*, the upper supporter 8 and the second link 4 are integrally formed.

Like the second link 4, the first link 3 is also rotatably engagingly supported by the upper engaging supporter 8, so that the first link 3 and the second link 4 are integrally formed with the upper engaging supporter 8. The integrally formed structure is a partially completed product. The upper engaging supporter 8, which is integrally formed with the first link 3 and the second link 4, can be supported by the back surface of the keytop 5 by being, for example, snappingly stopped thereby.

In this way, by forming a partially completed product by integrally forming the first link 3 and the second link 4 with the upper engaging supporter 8, it becomes easier to handle the first link 3 and the second link 4 when they are being assembled, so that assembly efficiency can be further enhanced.

In a third embodiment, as shown in FIG. 7, a bottom end 4*a* is engagingly supported by engaging supporting walls 9*a* of the lower engaging supporter 9, and the first link 3 and the second link 4 are integrally formed with the lower engaging supporter 9, thereby forming a partially completed product.

In a fourth embodiment, as shown in FIG. 8, the first link 3 and the second link 4 are engagingly supported by the upper engaging supporter 8 and the lower engaging supporter 9, respectively, thereby forming a partially completed product is formed.

In the second embodiment, the first and second links 3 and 4 are provided with an upper engaging supporter 8 that can rotatably support the top ends 3*f* and 4*f*. The first and second links 3 and 4 are supported by the back surface of the keytop 5 through the upper engaging supporter 8. In the third embodiment, the first and second links 3 and 4 are provided with a lower engaging supporter 9 that can rotatably support the bottom ends 3*a* and 4*a*. The first and second links 3 and 4 are supported by the upper surface of the base 2 through the lower engaging supporter 9. In the fourth embodiment, the first and second links 3 and 4 are provided with an upper engaging supporter 8 and a lower engaging supporter 9 that can rotatably support the top ends 3*f* and 4*f* and the bottom ends 3*a* and 4*a*, respectively. The first and second links 3 and 4 are supported by the back surface of the keytop 5 and the upper surface of the base 2 through the upper engaging supporter 8 and the lower engaging supporter 9, respectively.

Although, in the embodiments, the stationary contacts 2*c* and 2*c* of the switch circuit are directly formed on the base 2, the stationary contacts 2*c* and 2*c* may be formed on a sheet (not shown) that is formed of an insulating film and disposed on a metallic base 2.

For the switch circuit, a three-layer membrane (not shown) comprising two sheets, which allow a movable contact and stationary contacts to oppose each other, and a spacer, which separates the two sheets with a predetermined gap, may be used.

As described above, according to the keyswitch of the present invention, the first link and the second link each comprise two plates that are hinged so that they are foldable at the intersections as fulcra, and are disposed adjacent each other with a predetermined angle therebetween. Since, in response to the stretching and compression of the elastic member caused by vertically operating the keytop, the folding angles between the two plates of the first and second links are variable, the keytop can be vertically operated in a horizontal state using only two links. Therefore, the keyswitch has a simple structure and can be easily operated.

Since the first and second links are disposed orthogonally adjacent each other with the elastic member disposed therebetween, even if the same portion of the keytop is not pressed, it is possible to more reliably vertically move the keytop in the horizontal state.

Since the top and bottom ends of the first and second links are rotatably supported by the keytop and the base, respectively, it is possible to smoothly vertically move the first and second links in response to the vertical movement of the elastic member, so that the keyswitch can be easily operated.

Since the first and second links are supported by the back surface of the keytop through the upper engaging supporter that engagingly supports the top ends of the first and second links; or the first and second links are supported by the upper surface of the base through the lower engaging supporter that engagingly supports the bottom ends of the first and second links; or the first and second links are supported by the back surface of the keytop and the upper surface of the base through the upper engaging supporter that engagingly supports the top ends of the first and second links and through the lower engaging supporter that engagingly supports the bottom ends of the first and second links, the first and second links can be integrally formed to form a partially completed product. Therefore, the first and second links become easier to handle, so that it can be more easily assembled.

Since a height restricting member that can restrict the movement of the first and second links to the raised position at a predetermined height is disposed, the upward movement of the first and second links can be stopped at the predetermined height, so that it is possible to set the height of the keytop in its initial state before it is pressed at a constant value without variations.

Since the movement of the top ends of the first and second links is restricted to the raised position at the predetermined height by restricting the distance between facing side surfaces of the first and second links so that it does not become equal to or greater than a predetermined value, it is possible for the height restricting member to have a simple structure. Therefore, the keyswitch can be easily assembled.

Since the height restricting member bridges portions of adjacent side surfaces near the intersections, it is possible to use, for example, a commercially available flexible film or tapes.

What is claimed is:

1. A keyswitch comprising:

a keytop;

a first link and a second link for vertically movably supporting the keytop;

an elastic member for elastically biasing the keytop upward;

a base for supporting the elastic member; and a movable contact and a stationary contact for switching states of a switch circuit by vertically operating the keytop, wherein the first and second links each have two plates that are hinged so as to be foldable at an intersection, the first and second links being disposed adjacent each other with a predetermined angle therebetween, and wherein, in response to stretching and compression of the elastic member resulting from vertically operating the keytop, folding angles between the two plates of the first link and between the two plates of the second link are variable.

2. A keyswitch according to claim 1, wherein the first and second links are disposed orthogonally adjacent each other, with the elastic member being disposed therebetween.

3. A keyswitch according to claim 1, wherein top ends of the first and second links are rotatably support by the keytop, and wherein bottom ends of the first and second links are rotatably supported by the base.

4. A keyswitch according to claim 1, wherein the first and second links are provided with one of: an upper engaging supporter that rotatably engagingly supports top ends, and are supported by the back surface of the keytop through the upper engaging supporter; a lower engaging supporter that rotatably engagingly supports and are supported by an upper surface of the base through the lower engaging supporter; and upper engaging supporter and the lower engaging supporter that, respectively, rotatably engagingly support the top ends and the bottom ends, and are supported by the back surface of the keytop and the upper surface of the base through the upper engaging supporter and the lower engaging supporter, respectively.

5. A keyswitch according to claim 1, further comprising a height restricting member for restricting movement of the first and second links to a raised position at a predetermined height.

6. A keyswitch according to claim 5, wherein, as a height of top ends of the first and second links increases in response to stretching and compression of the elastic member, a distance between adjacent side surfaces of the first and second links increases, and wherein the height restricting member restricts movement on the top ends of the first and second links to the raised position at the predetermined height by restricting the distance between the adjacent side surfaces so that the distance is maximized at a predetermined value.

7. A keyswitch according to claim 6, wherein the height restricting member bridges portions near intersections of the adjacent side surfaces.

* * * * *

UNITED STATES PATENT AND TRADEMARK OFFICE

CERTIFICATE OF CORRECTION

PATENT NO. : 6,864,449 B2
DATED : March 8, 2005
INVENTOR(S) : Hideki Ito

It is certified that error appears in the above-identified patent and that said Letters Patent is hereby corrected as shown below:

Column 8,
Line 52, after "rotatably" delete "support" and substitute -- supported -- in its place.

Signed and Sealed this

Ninth Day of August, 2005

JON W. DUDAS
*Director of the United States Patent and Trademark Office*